US006464199B1

(12) United States Patent
Johnson

(10) Patent No.: US 6,464,199 B1
(45) Date of Patent: Oct. 15, 2002

(54) MOLDS FOR PRODUCING MASONRY UNITS WITH ROUGHENED SURFACE

(75) Inventor: Jay Jeffrey Johnson, Star Prairie, WI (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 09/691,898

(22) Filed: Oct. 19, 2000

(51) Int. Cl.[7] ..... B28B 7/10
(52) U.S. Cl. ..... 249/117; 249/140; 425/443
(58) Field of Search ..... 249/117, 140; 425/352, 253, 443

(56) References Cited

U.S. PATENT DOCUMENTS

| | | | | |
|---|---|---|---|---|
| 824,235 | A | | 6/1906 | Damon |
| 1,219,127 | A | | 3/1917 | Marshall |
| 1,465,608 | A | | 8/1923 | McCoy |
| 3,940,229 | A | | 2/1976 | Hutton |
| 3,981,953 | A | | 9/1976 | Haines |
| 4,218,206 | A | | 8/1980 | Mullins |
| 4,660,344 | A | | 4/1987 | Gaudelli et al. |
| 4,784,821 | A | | 11/1988 | Léopold |
| 4,869,660 | A | | 9/1989 | Ruckstuhl |
| 5,062,610 | A | | 11/1991 | Woolford et al. |
| 5,078,940 | A | | 1/1992 | Sayles |
| 5,087,188 | A | * | 2/1992 | Staver |
| 5,217,630 | A | | 6/1993 | Sayles |
| 5,249,950 | A | | 10/1993 | Woolford |
| 5,879,603 | A | | 3/1999 | Sievert |
| 6,113,379 | A | | 9/2000 | LaCroix et al. |
| 6,138,983 | A | | 10/2000 | Sievert |
| 6,209,848 | B1 | | 4/2001 | Bolles et al. |

FOREIGN PATENT DOCUMENTS

| | | | |
|---|---|---|---|
| GB | 944066 | | 12/1963 |
| JP | 5-169416 | * | 7/1993 |

OTHER PUBLICATIONS

Copy of application Ser. No. 09/691,931, filed Oct. 19, 2000.

* cited by examiner

*Primary Examiner*—James P. Mackey
(74) *Attorney, Agent, or Firm*—Merchant & Gould P.C.

(57) ABSTRACT

A mold which is easy to fabricate and which is durable and self cleaning. The mold is especially suited for creating fine or modest roughened surfaces on concrete masonry units. These moderately roughened surfaces are suitable for use as the decorative face(s) on concrete products such as bricks and blocks. The desired result of producing a modest or fine roughened surface on a masonry unit can be performed in a mold without using protruding lips or wall projections or grates, although such features could be used to supplement the action described herein. According to the present invention, one or more shallow channels or grooves are cut or otherwise formed in the face of the mold wall or walls or other generally vertical surface(s) within the mold from which it is desired to produce a roughened surface on a masonry unit.

10 Claims, 8 Drawing Sheets

MOLDS FOR PRODUCING MASONRY UNITS WITH ROUGHENED SURFACE

BACKGROUND OF THE INVENTION

Concrete masonry units are available in a wide range of sizes and shapes, and are used for a variety of applications ranging from concrete blocks and bricks to segmental retaining wall blocks (the latter are sometimes called "SRW" blocks).

Depending on the intended end-use application of the concrete masonry units being produced, the surface appearance of the units may be important and the marketplace has come to expect various decorative or cosmetic surface finishes for many masonry units. Such surface finishes include those commonly described as broken or split, striped, striated, simulated broken, and smooth (alone or in combination with one of the other surface finishes). One such surface finish is a texture that resembles the appearance of a "split" rock. A "split" surface finish on a concrete masonry unit may be achieved by mechanically splitting away a portion of a face of the masonry unit. This is typically achieved with a mechanical splitting blade similar to a guillotine and the splitting is performed on the masonry units after they have been cured or hardened. To avoid waste, this is often done by first forming the masonry units as "Siamese" twins and then splitting them apart. The resulting fractured surface on the front face of both blocks is generally thought to be pleasing to look at and is sought after.

The mechanical splitting of masonry units is an added cost of processing since one must invest in the splitting equipment, and transport the masonry units from their place of curing to the splitter, and then to a suitable collection station for palletizing or the like. When the applicable capital, labor and other costs (e.g. utilities and floor space) are added together, this added cost is significant. This cost provides a substantial incentive to develop new methods of roughening the surface of masonry units to create a desirable surface finish without the need to mechanically split the masonry units. Although some approaches have involved processing steps to be performed on the green or uncured masonry units immediately after they are discharged from the mold, the most common approach has been to modify the mold in some fashion so that a roughened surface is produced on the concrete masonry units as they are ejected from the mold (i.e. the masonry units are roughened in the mold cavity).

For example, U.S. Pat. No. 3,940,229 describes a mold for making concrete masonry units with a roughened texture on at least one face. The mold has a wall with a lip on the lower edge of the wall, that projects inwardly into the mold cavity. The lip is rectangular in profile, and it may be smooth or it may be serrated to provide sawtooth-like projections. As the shaped but uncured concrete masonry unit is forced out of the bottom of the mold, the patent says that the protruding lip produces a scraping or tearing action on the adjacent face of the concrete masonry unit so as to roughen the surface of the masonry unit. Although a small amount of fill material will loosely rest on or adhere to the mold wall above the lip after use, the mold of U.S. Pat. No. 3,940,229 is self-cleaning since the small amount of material that remains loosely adhered to the mold wall after the mold is stripped is knocked clear of the wall when the next machine pallet is placed against the mold bottom and the mold is vibrated. Experiments with this type of mold demonstrate that it produces a roughened surface on the concrete unit, but that the face sometimes has a slight "shingled" appearance. Further, the lip is relatively small, and wear is a problem with the passage of time due to the abrasive nature of the moldable fill material from which the concrete masonry unit is formed. The lip is also susceptible to damage if the head of the block machine is not properly aligned. Replacing the lip is time consuming. Sometimes a new lip is welded to the mold and at other times a new mold wall is made.

A modified form of the lip design of U.S. Pat. No. 3,940,229 has been developed and that modified lip design is the subject of U.S. Pat. No. 6,209,848 entitled "MOLD FOR PRODUCING MASONRY BLOCK WITH ROUGHENED SURFACE". According to that patent (which is incorporated herein by reference), a satisfactory roughened surface is produced by forming grooves in a wedge shaped lower lip with the grooves at an angle to the direction of travel that the material moves through the mold. Masonry units made with this improved mold seem to have less shingling than units made with a solid or serrated lower lip. The mold remains self-cleaning. However, the grooves in the lower lip are subject to the same wear and damage as the lower lip of U.S. Pat. No. 3,940,229.

U.S. Pat. Nos. 5,078,940 and 5,217,630 describe a somewhat different type of mold for making concrete masonry units with a roughened surface. Although the molds described in these patents also employ a protruding lip on the lower edge of at least one wall of the mold, the lip is wedge-shaped in profile. In addition, the mold includes a plurality of projections above the lip on the same wall and these multiple projections also intrude into the mold cavity. In addition, an optional mesh extends upwardly from the lip generally close to and parallel to the wall and associated projections. In use, concrete fill material is introduced into the mold and compressed to a size slightly "oversize" of the desired masonry unit. The projections and the mesh are designed to retain a meaningful portion of the concrete fill material in place against the wall of the mold as the formed concrete masonry unit is forced out of the bottom of the mold. As described in these patents, the concrete fill material held against the mold wall by the projections and the mesh is sheared from the concrete masonry unit that is being forced out of the mold, thus forming a roughened surface on the concrete masonry unit as it is ejected from the mold. These patents teach that the mold is then re-used one or more times to make additional masonry units and the concrete fill material retained in the mold remains in place and reportedly assists in roughening the surface of the masonry units that are successively formed in the same mold. Molds of this type are not self-cleaning, but are designed to retain fill material on the projections and against a wall of the mold during successive machine cycles. It is believed that molds of this design, although without the mesh, have been commercialized under the trademark "Softsplit". Others familiar with the use of this process on a commercial scale have reported that the process must occasionally be interrupted to clean out the fill material that agglomerates around the projections since the fill material eventually becomes too hard for this process to be effective. This is not necessarily an easy cleaning process. It depends upon how accessible the mold face is to the machine operator. In many of the commonly used concrete block machines, the mold faces are relatively difficult to get at, and safety dictates that precautions such as machine lockouts and the like be used when the cleaning process is undertaken. The cleaning process is not easy, and is costly since production is interrupted for cleaning to take place.

U.S. Pat. No. 5,879,603 describes an improvement to the '229 style mold. The '603 patent describes a mold with a wedge-shaped lower lip and an upper lip spaced apart from the lower lip by the distance defining the height of the concrete unit to be produced. Both lips protrude into the mold cavity. The mold acts in a similar fashion to the molds of U.S. Pat. No. 3,940,229, but produces less "shingling" effect on the roughened face, and is also self-cleaning in the same fashion, i.e. the concrete fill material that loosely adheres to the lower lip and to the mold wall above the lower lip is knocked off the wall when the next pallet is brought into place beneath the mold and the mold is vibrated.

U.S. Pat. No. 6,113,379 describes another style of mold for roughening the surface of a masonry unit as it is ejected from the mold. This mold incorporates an expanded metal grate, which spans a single mold cavity, dividing it into to sub-cavities which are in communication with each other. Fill material is introduced into the mold cavity, and the fill material is compressed. During this time, the fill material passes through the grate and a single molded article is made which occupies both sub-cavities. As the single molded article is ejected from the mold, the grate divides the molded unit into two masonry units, which are both ejected from the mold. During the process of being ejected from the mold, the faces of the masonry units, which were adjacent the expanded metal grate, are roughened. Experiments have shown this mold to be self cleaning, and any fill material that is loosely attached to or suspended on the grate or delicately balanced in the grate openings is readily dislodged and drops to the pallet when the mold is vibrated as part of the next machine cycle.

At times, it is desired to produce a more modest or fine roughening of a masonry unit than is typically produced when mechanically splitting a block. Unfortunately, the molds used to produce pronounced roughening are often unsuited for the more modest roughening. If they are scaled down to produce more moderate roughening, they often have more delicate features that lack the desired strength and wearability.

Modest roughening of one or more surfaces of a masonry unit such as a brick or block is useful not only as the only surface finish, but is useful in combination with mechanical splitting where the modest roughening can be performed on surfaces of the block which are not to be mechanically split, but which may be visible to the observer when the products are used, for example, to create a retaining wall. By roughening the surfaces immediately adjacent to the mechanically split surface(s), light striking the adjacent surfaces is scattered and the reflections associated with smooth reflective surfaces are avoided.

SUMMARY OF THE INVENTION

The present invention is a still different type of mold, which is easy to fabricate and which is durable and self-cleaning. This new mold is especially suited for creating fine or modest roughened surfaces on concrete masonry units. These moderately roughened surfaces are suitable for use as the decorative face(s) on concrete products such as bricks and blocks.

The desired result of producing a modest or fine roughened surface on a masonry unit can be performed in a mold without using protruding lips or wall projections or grates, although such features could be used to supplement the action described herein. For simplicity, such features, especially the more complicated ones, will usually be avoided.

According to the present invention, one or more shallow channels or grooves are cut or otherwise formed in the face of the mold wall or walls or other generally vertical surface (s) within the mold from which it is desired to produce a roughened surface on a masonry unit. These channels are not parallel to the direction in which the mold is stripped, but rather are perpendicular to or oblique to the direction of stripping. In its simplest form, a single and generally horizontal channel (i.e. a channel perpendicular to the direction of stripping) will be cut across the face of a wall of the mold, generally near the bottom of the wall (e.g. less than about 0.5 inches from the bottom of the mold and usually less than about 0.1 inch from the bottom of the mold) adjacent the point where the masonry unit will be ejected from the mold. The depth and height of the channel will he selected to provide the optimum or desired surface roughness for the intended application, taking into consideration the mix design for the fill material, which includes aggregate size and distribution, amount and type of cement, and amount of water. Although the channel can be rectangular in cross section, other shapes can be used such as semi-circular or v-shaped or ear-shaped, and multiple channels can be used. These multiple channels can be at the same or different heights on the mold wall. The channels may be generally parallel to the bottom of the mold or they may be skewed or even non-linear such as serpentine. Criss-cross patterns can be used. The channels may extend partly or entirely across the face of the mold.

Molds of the present design are self-cleaning since the channels are shallow and any loose fill material lying in the channels is readily shaken loose by the vibration of the mold. Further, the rapid wear problems associated with thin protruding lower lips like those used in U.S. Pat. No. 3,940,229 are minimized, and the potential for damage to protruding lips such as those of U.S. Pat. No. 3,940,229 due to head misalignment are minimized if not eliminated.

Further, these same channel features can be provided on other generally vertical shaping surfaces of the mold, and these other surfaces need not be planar although it is preferred to use the channels of the present invention as a feature on one or more of the generally planar vertical walls of the mold.

DETAILED DESCRIPTION OF THE INVENTION

The invention is a design feature for molds (and inserts) for producing concrete masonry units having a roughened texture on at least one of their side or vertical surfaces. The invention may be used with any number of different types of molds to produce a broad range of concrete masonry products where a roughened surface texture is desired.

Figure 1:
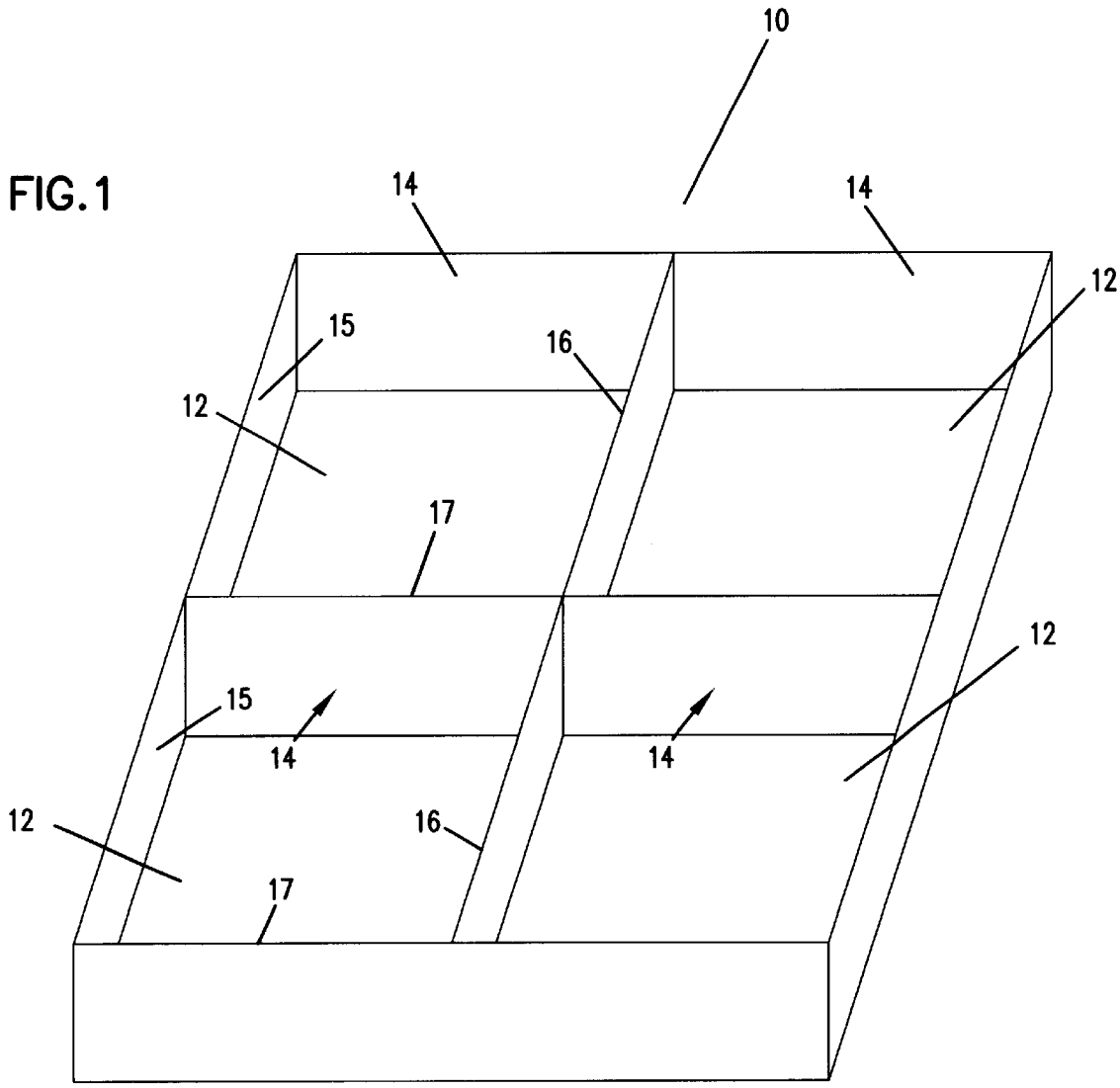
FIG. 1 is a perspective view of a mold having multiple cavities for producing concrete masonry units.

FIG. 1 shows a typical mold 10 for making concrete masonry units such as bricks or blocks. The mold may have one or more cavities 12 and the mold shown in FIG. 1 has four cavities of the type used to make concrete bricks (typical brick molds may have 12 or more cavities). The relative dimensions have been altered to better illustrate the invention. Multiple cavity molds are used to simultaneously produce multiple products which may be the same or different. As shown in FIG. 1, side walls 14, 15, 16, and 17 collectively define each mold cavity 12. Each mold cavity 12 is open at its top and bottom. As is well known to those of ordinary skill in the art, molds for use in commercial brick and block plants, are designed to be mounted in a machine suitable for mass-producing concrete products, such as blocks, slabs, or pavers, from low slump concrete fill material. There are many of these types of machines available. Some of the manufacturers of these machines are Besser, Columbia, Fleming, Tiger, KVM, Masa, Zenith, and Omag.

When a mold such as the mold 10 of FIG. 1 is mounted in one of these block or brick making machines, it is common for a pallet to be moved into position under the mold. The pallet is typically a plate of steel or other rigid sheet material, and this pallet closes the bottom of each mold cavity so the mold can be filled with suitable curable fill material. The open top of each mold cavity allows concrete fill material to be loaded into each mold cavity, typically via a feed drawer that moves horizontally across the top of the mold. This filling is usually accompanied by vibration to assist in obtaining a good fill of the mold without voids in the fill material. Depending upon the type of block or brick machine used, the vibration may be applied directly to the mold, or to the pallet, or to both. Once the feed drawer has retracted, a compression head (not shown) descends on the top of the mold cavity. The compression head forms (shapes) the top of the molded unit and provides additional compaction of the fill material. After the fill material is molded or shaped within the mold by the boundaries consisting of the mold on all sides, the pallet on the bottom, and the compression head on top, the mold and the pallet are separated and the shaped (but uncured) fill material in the form of a masonry unit is discharged through the open bottom of the mold cavity by the action of the compression shoe travelling through the mold cavity. The resulting molded concrete masonry unit is then cured (e.g. cured by natural curing when stored outdoors or by accelerated curing in an autoclave or steam room).

Suitable fill materials include any of the common concrete mixes used to make blocks, bricks, pavers, and the like. As is known in the art, such fill materials contain aggregates such as sand and gravel, cement, and water. Fill materials may contain pumice, quartzite, taconite, and other natural or man-made fillers. They may contain other additives such as color pigment and chemicals to improve such properties as water resistance, cure strength, and the like. The ratios of various ingredients, and the types of materials and sieve profiles can be selected within the skill of the art and are often chosen based on local availability of raw materials, technical requirements of the end products, and the type of machine being used. A typical fill material for concrete bricks will contain, on a weight basis, 2400 parts of sand, 2400 parts of buckshot (small rocks having a maximum sieve dimension of less than 3/16 inch), 480 parts of Type 3 cement, 120 parts of Type C flyash, and a commercial additive known as "Dry Block".

Figure 10:
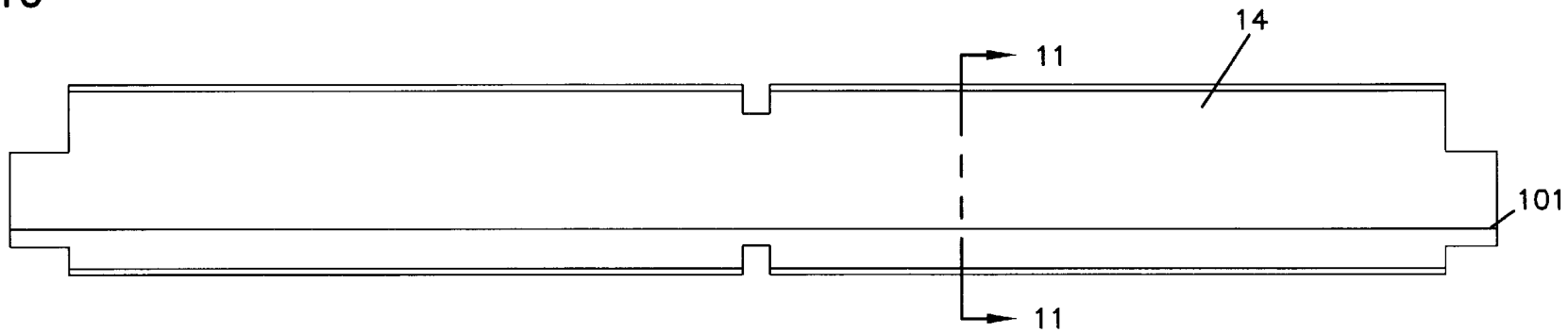
FIG. 10 is a front view of the front wall of a mold in which a single horizontal groove or channel has been cut in the front wall close to the bottom of the front wall.

The present invention involves a modification of the mold or other vertical shaping surface of a mold so that the mold will cause a roughening of a surface of the molded concrete masonry unit as the unit is discharged from the mold. A preferred arrangement is to form a single, shallow horizontal channel near the bottom edge of the wall of the mold where the roughened surface is to be created. By "shallow" it is meant that the ratio of the width G of the channel (see FIG. 3) to the maximum depth D of the channel (see FIG. 3) is at least about 1:1, and is often greater than 1:1 (e.g. at least about 2:1). One preferred arrangement is shown in FIG. 10 where the cross section of the channel 101 can be of any variety of shapes such as rectangular, triangular, hemispherical, etc. Although not wishing to be bound to any theory, it is believed that some of the fill material temporarily resides in the channel during the molding process. This is referred to as "channel fill material". As the compressed and molded fill material is discharged from the mold cavity, this channel fill material begins to be disturbed or disrupted by the movement of the masonry unit within the mold cavity and the channel fill material is caused to tumble or roll against the passing surface of the masonry unit, causing it to roughen. It seems likely that the channel fill material is constantly being changed/replenished as the masonry unit passes by the channel during discharge of the masonry unit from the mold cavity. Regardless of the mechanism, the surface of the passing masonry unit is roughened. This effect can be achieved by means of a single channel of appropriate size and shape, or by means of a series of channels located in the appropriate face(s) of the mold cavity. As noted earlier, at least one of these channels will be oblique (preferably perpendicular) to the direction of stripping of the mold. This is important so that one does not merely create a vertical stripe or series of vertical stripes on the face of the block.

The depth and height of each channel will be selected to provide the optimum or desired surface roughness for the intended application, taking into consideration the mix design for the fill material, which includes aggregate size and distribution It has been noted that if the channel is too large, some large aggregate can be held within the channel during the block making process, and the larger aggregate held in the channel may cause the face of the masonry unit to be scored so that it is readily visible when looking at the finished masonry unit (usually an undesirable result). For most applications, it has been found that the height of the channel (e.g. dimension G of FIGS. 3 and 5 ) will be less than about 0.75 inches, and usually less than about 0.6 inches. Channel heights of from about 0.15 to about 0.6 inches are particularly useful. Channel depths (dimension D of FIG. 3) are usually less than about 0.5 inches and usually less than about 0.35 inches. Depths of about 0.1 to about 0.25 inches are quite desirable. In general, if the channel is made wider, it should also be made shallower so that the amount of channel fill material is not too great, and large aggregate will not be held in the channel. When the masonry unit is discharged from the mold cavity, any channel fill material remaining in the channel(s) will tend to fall out of the channel, especially during the vibration of the mold. In this sense, the preferred mold designs are self-cleaning, and it is not necessary to interrupt production to clear the mold wall 14 of compacted fill material. By making tie channels shallow, fill material is not retained in the channels from cycle to cycle so that it can harden. This is undesirable and will defeat the desired goal of having fresh, uncured, soft fill material tumble or roll against the passing surface of a concrete masonry unit being discharged from the mold cavity.

Although the groove or channel can be rectangular in cross section, other shapes can be used such as v-shaped, semi-circular or ear-shaped, and multiple grooves or channels can be used. These multiple grooves or channels can be at the same or different heights on the mold wall. The channels may be generally parallel to the bottom of the mold or they may be skewed or even non-linear such as serpentine. Criss-cross patterns can be used. The grooves may extend partly or entirely across the face of the mold. For reasons not presently understood, some of the channel patterns (e.g. criss-cross) tend to be repeated or mirrored in the surface of the finished masonry units, which produces interesting visual effects when the masonry units are assembled into a wall or other structure.

Figure 4:
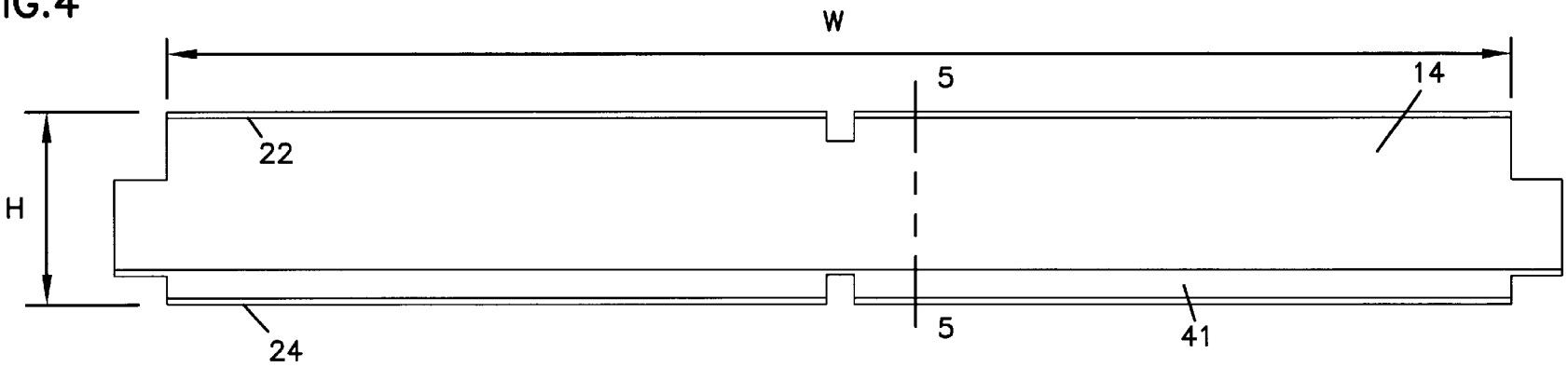
FIG. 4 is a front view of the front wall of a mold in which a single horizontal groove or channel has been cut in the front wall close to the bottom of the wall.

The size and shape and location of the grooves or channels can be understood by reference to the drawings, with particular emphasis on FIGS. 4 and 10.

As shown in FIG. 4, the front wall 14 of the mold 10 has a top 22 and a bottom 24. In practice, many blocks are made upside down so that the top of the concrete masonry unit as formed in the mold is really the bottom of the concrete masonry unit when it is used, but regardless of orientation, the relative movement of the mold and molded masonry unit during production is such that the molded article is discharged from the mold at the bottom as shown on FIG. 4. Thus, the direction of stripping is generally parallel to the dimension H and is from top to bottom.

As shown in FIG. 4, the front wall has a height H and a width W for a total projected surface area equal to H×W. In a similar fashion, the channel has a height G for a total projected surface area equal to G×W. The ratio of H×W divided by G×W is a useful measure of how much channeling has been done to the surface of the front wall 14. In practice, this ratio of total projected area of the mold wall to the total projected area of the channel(s) will usually be more than about 2:1 and preferably more than about 4:1. Ratios of about 10–50:1 are usually optimum. This means that the desired surface roughening can be obtained with only a modest amount of channeling. This simplifies construction of the mold. For many applications, it is preferred to use a single horizontal channel located within about 0.5 inches of the lower edge or bottom of the front wall 14, and extending substantially completely across the front of the wall 14.

Typically, at least one of the channels will be spaced from the top 22 by more than 40% of the distance H from the top to the bottom of the front wall 14 and more usually, at least one of the channels will be at or below the mid-point of the front wall (50% of H). Placing at least one of the channels further down the front wall 14 (e.g. at least 60% of the way down and preferably at least 75% of H) will provide more desirable surface roughening for most applications. In this regard, the location of the channel determines where on the masonry unit the roughening begins, since the face of the molded masonry unit below the lowest channel is not affected by the action of the channel and will retain its natural surface finish. Where it is desired to achieve surface roughening of almost the entire front face of the molded masonry unit, at least one channel should be placed as close to the bottom of the front wall 14 as is practical. Typically this will be within about 0.1 inch of the bottom of the front wall 14 (commonly referred to as a wear plate). By contrast, moving the lowest channel up the front wall 14 will result in a portion of the face of the molded masonry unit being roughened and a portion will not be roughened. This cosmetic look (partially roughened and partially smooth surface) may be desired for some applications.

For some applications it may be desirable to place the channels on only a portion of the width of the face of the front wall so that a masonry unit can be produced with surface roughening on, for example, only the left half of the front face. In addition, a channel could vary in height and/or depth over its length which could lead to different surface roughening effects on the face of a masonry unit, which may be a desired cosmetic look for some applications.

The invention is further illustrated by the drawings in which like numerals represent like features.

Figure 2:
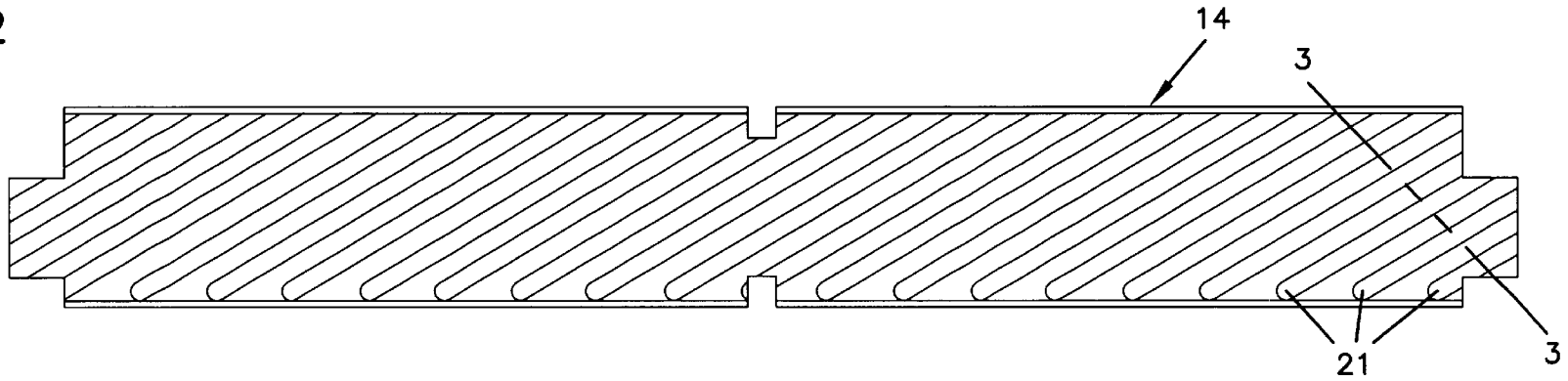
FIG. 2 is a front view of the front wall of a mold in which multiple shallow diagonal grooves or channels have been cut in the front wall at an angle to the horizontal of about 30 degrees.

FIG. 2 is a front view of the front wall 14 of a mold cavity in which multiple shallow diagonal grooves or channels 21 have been cut in the front wall at an angle to the horizontal of about 30 degrees. A typical size is for the channels is about 0.25 inches wide G, about 0.03 inches deep D, and a space S of about 0.25 inches between channels.

Figure 3:
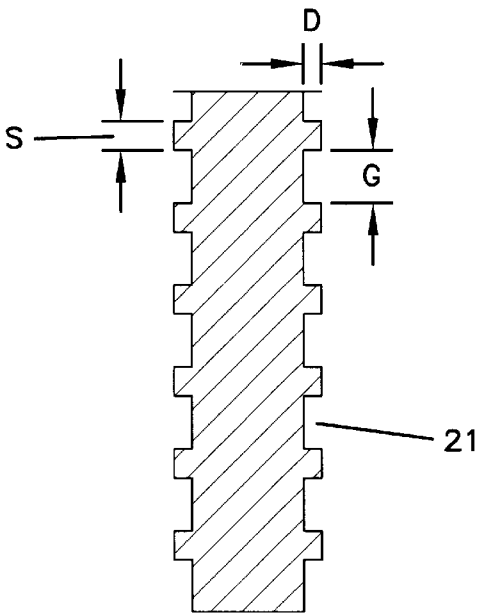
FIG. 3 is a sectional view of the mold shown in FIG. 2 taken at line 3—3 to show the cross section of the grooves.

FIG. 3 is a sectional view of the mold shown in FIG. 2 taken at line 3—3, to show the shallow, rectangular cross section of the grooves 21.

FIG. 4 is a front view of the front wall 14 of a mold cavity in which a single horizontal groove or channel 41 has been cut in the front wall close to the bottom of the wall. A suitable size for the channel 41, which is semi-circular, can be about 0.375 inches diameter (dimension G) and the channel will be within about 0.1 inches of the bottom of the wall 14.

Figure 5:
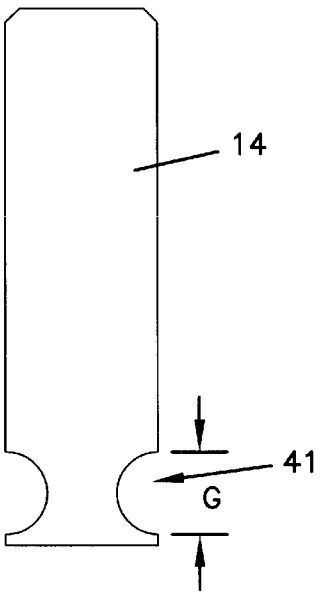
FIG. 5 is a sectional view of the mold shown in FIG. 4 taken at line 5—5 to show the cross section of the groove.

FIG. 5 is a sectional view of the mold shown in FIG. 4 taken at line 5—5 to show the semi-circular cross section of the groove 41. Alternatively, the channel 41 could be rectangular in cross-section.

Figure 6:
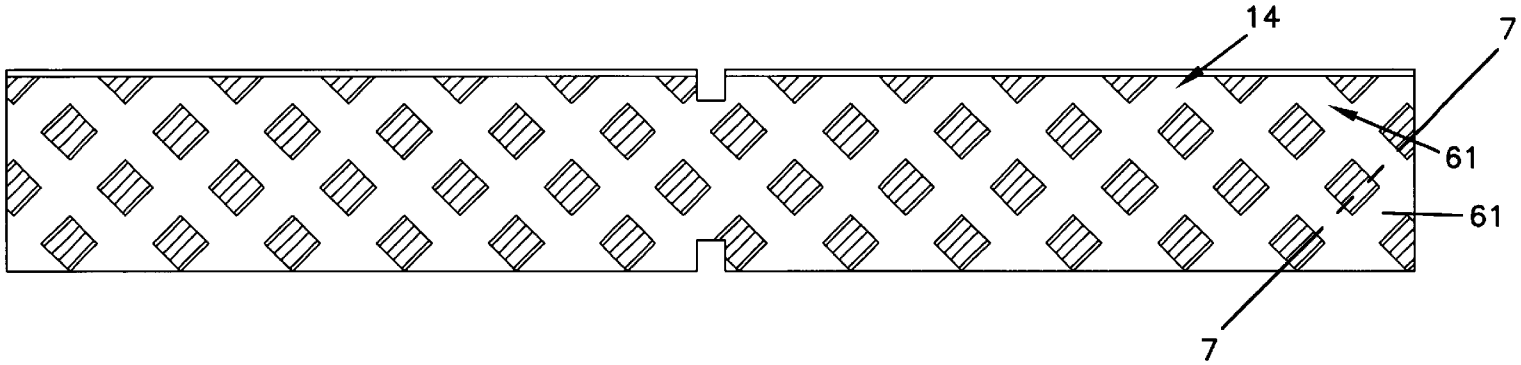
FIG. 6 is a front view of the front wall of a mold in which multiple, shallow, diagonal grooves or channels have been cut in the front wall at an angle to the horizontal of about 45 degrees to provide a "criss-cross" pattern.

FIG. 6 is a front view of the front wall 14 of a mold in which multiple diagonal grooves or channels 61 have been cut in the front wall at an angle to the horizontal of about 45 degrees to provide a "criss-cross" pattern. The channels 61 are about 0.5 inches wide, about 0.03 inches deep, and are spaced 0.5 inches apart.

Figure 7:
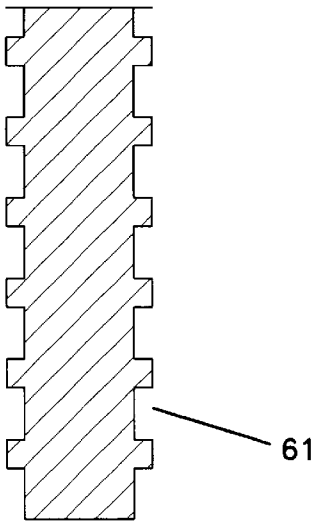
FIG. 7 is a sectional view of the mold shown in FIG. 6 taken at line 7—7, to show the cross section of the grooves.

FIG. 7 is a sectional view of the mold shown in FIG. 6 taken at line 7—7, to show the cross section of the grooves 61.

Figure 8:
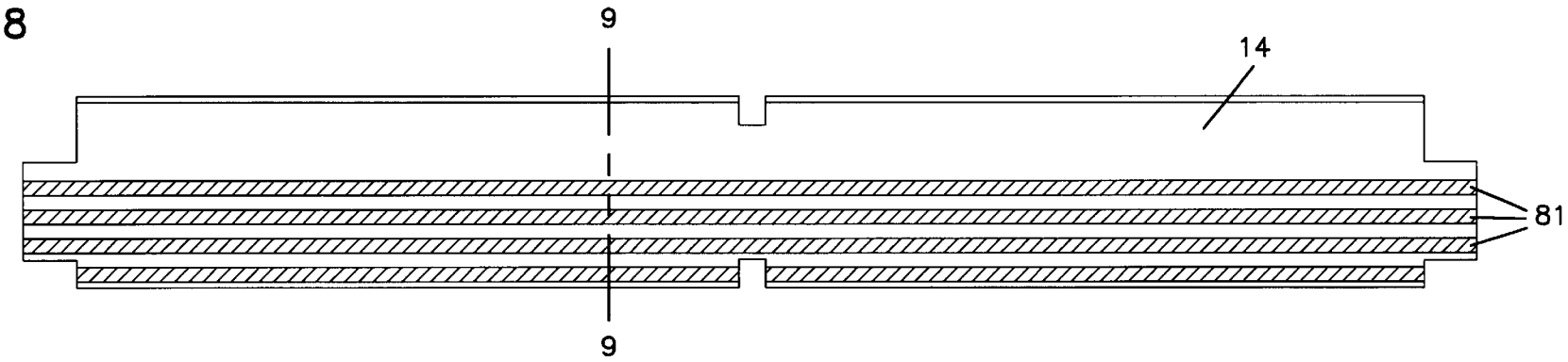
FIG. 8 is a front view of the front wall of a mold in which multiple horizontal grooves or channels have been cut in the front wall, extending from near the bottom of the mold wall to near the top of the mold wall.

FIG. 8 is a front view of the front wall 14 of a mold in which multiple horizontal grooves or channels 81 have been cut in the front wall, extending from near the bottom of the mold wall to near the top of the mold wall. The channels are about 0.1875 inches wide, about 0.09 inches deep and spaced about 0.1875 inches apart starting about 0.050 inches from the bottom of the front face of the wall. Although this arrangement provides a desirable degree of surface roughening, no significant advantage was noted for the large number of channels when compared to the use of only one or a few channels located near the bottom of the mold wall.

Figure 9:
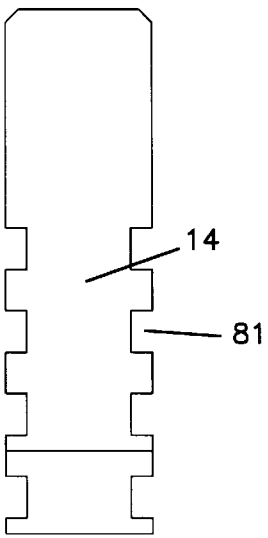
FIG. 9 is a sectional view of the mold shown in FIG. 8 taken at line 9—9, to show the cross section of the grooves.

FIG. 9 is a sectional view of the mold shown in FIG. 8 taken at line 9—9, to show the cross section of the grooves 81.

FIG. 10 is a front view of the front wall 14 of a mold in which a single horizontal groove or channel 101 has been cut in the front wall close to the bottom of the front wall. The channel is about 0.500 inches wide, about 0.020 inches deep, and starts about 0.050 inches from the bottom of the mold. It is V-shaped in cross section.

Figure 11:
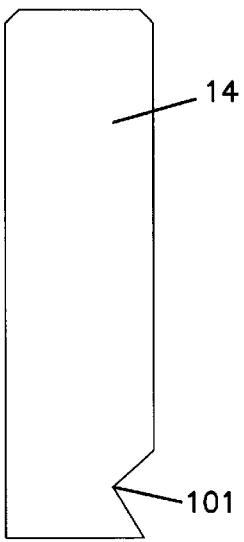
FIG. 11 is a sectional view of the mold shown in FIG. 10 taken at line 11—11, to show the cross section of the groove.

FIG. 11 is a sectional view of the mold shown in FIG. 10 taken at line 11—11, to show the V-shaped cross section of the groove 101.

Figure 12:
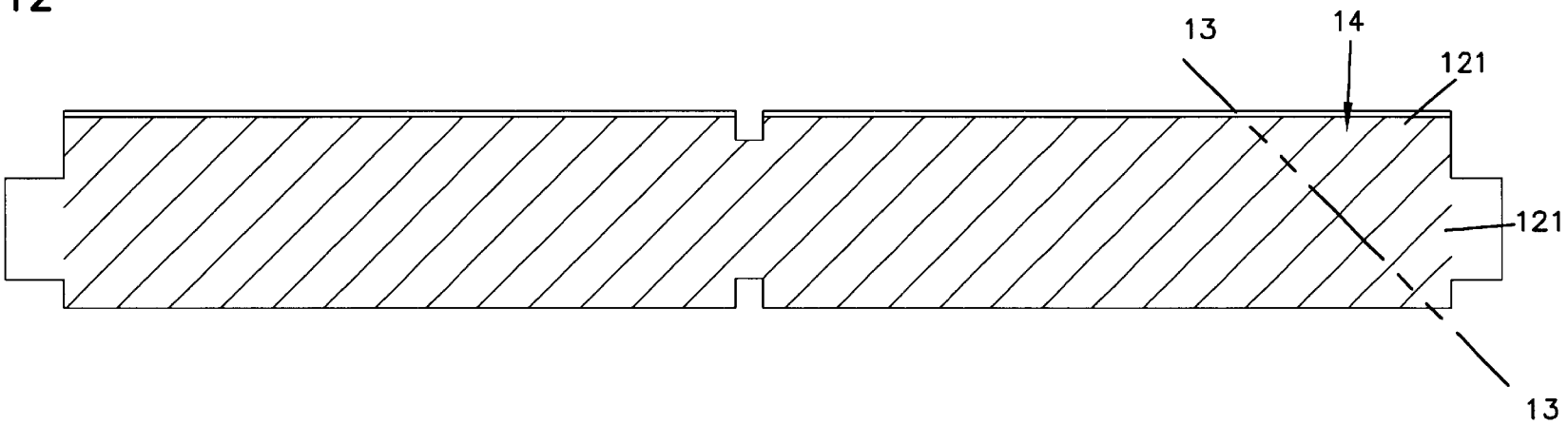
FIG. 12 is a front view of the front wall of a mold in which multiple diagonal grooves or channels have been cut in the front wall at an angle of 45 degrees from the horizontal.

FIG. 12 is a front view of the front wall 14 of a mold in which multiple diagonal grooves or channels 121 have been cut in the front wall at an angle of about 45 degrees from the horizontal. The channels are about 0.50 inches wide, about 0.03 inches deep, and spaced about 0.50 inches apart.

Figure 13:
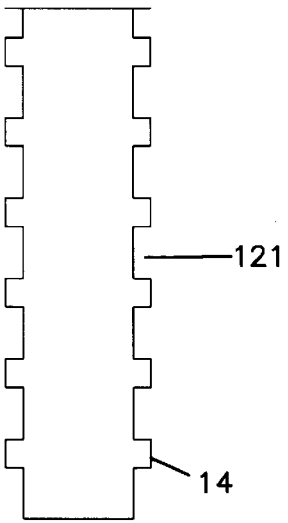
FIG. 13 is a sectional view of the mold shown in FIG. 12 taken at line 13—13, to show the cross section of the groove.

FIG. 13 is a sectional view of the mold shown in FIG. 12 taken at line 13—13, to show the cross section of the grooves 121.

Figure 14:
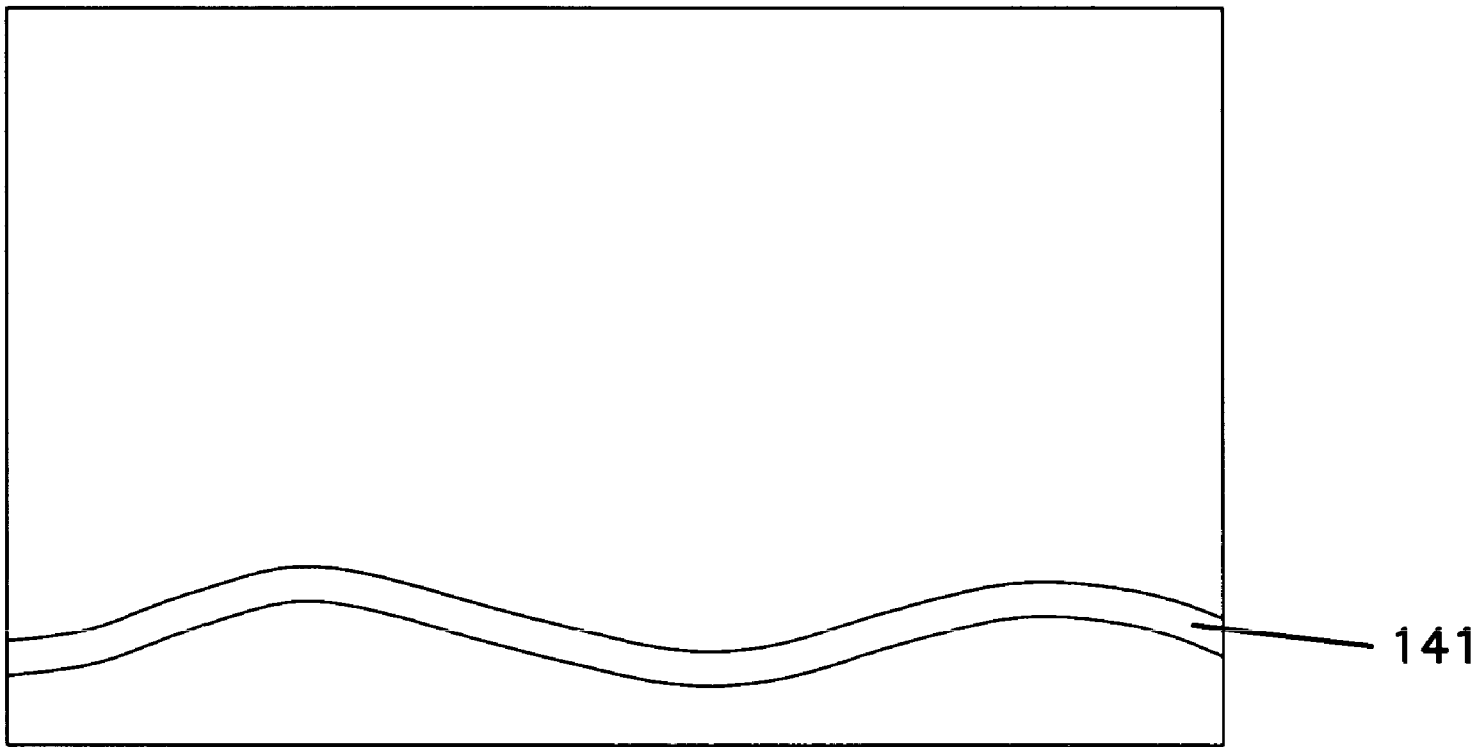
FIG. 14 is a front view of a wall of a mold in which a serpentine groove or channel has been cut.

FIG. 14 illustrates a serpentine groove or channel 141 in a wall of a mold.

The molds shown in FIGS. 2–14, when used with suitable fill materials such as the illustrative mix design previously described, produce a relatively fine (or modest) roughened texture on the surface of the masonry units which are stripped past their respective channel(s). When using the preferred mold (a single horizontal channel like that of FIG. 10), shingling is minimized, mold fabrication is relatively easy, mold wear is acceptable, and mold damage due to head misalignment is minimized.

Once the blocks are formed with a roughened surface, they may be cured through any means known to those with skill in the art. Curing mechanisms such as simple air curing, autoclaving, steam curing or mist curing are all useful methods of curing the blocks resulting from this invention.

What is claimed is:

1. A mold for producing at least one masonry unit with a texture on at least one surface, the mold comprising:

a) a plurality of side walls defining a mold cavity open at its top and bottom to allow masonry fill material to be introduced into the mold cavity by way of its open top and to discharge molded fill material in the form of a molded masonry unit by way of its open bottom;

b) at least one surface texturing channel formed in the face of at least one of said side walls, said channel extending substantially across the entire face of said side wall in a direction not parallel to the direction of stripping of the mold, said channel having a height of less than about 0.75 inches and a depth of less than about 0.50 inches, and at least a portion of said channel is spaced from the top of said side wall in which it is formed by a distance that is more than about 40% of the distance from the top of said side wall to the bottom of said side wall; and c) said mold being further characterized by a ratio of the total projected area of said side wall provided with said channel to the total projected area of said channel being more than 2:1.

2. The mold of claim 1 in which there is only a single channel in said side wall of said mold, said side wall in which said channel is formed is smooth and planar except for said channel, and said channel is located near the bottom of said side wall.

3. The mold of claim 2 in which said channel is horizontal.

4. The mold of claim 1 in which said channel has a cross section that is rectangular.

5. The mold of claim 1 in which said channel has a cross section that is semi-circular.

6. The mold of claim 1 in which there are multiple channels in the same said side wall.

7. The mold of claim 1 in which at least a portion of said channel is spaced from the top of said side wall in which it is formed by a distance that is at least about 75% of the distance from the top of said side wall to the bottom of said side wall.

8. The mold of claim 1 in which there are multiple channels in the same said side wall, and said channels are skewed from the horizontal.

9. The mold of claim 1 in which the ratio of the total projected area of said side wall provided with said channel to the total projected area of said channel being about 10–50:1.

10. The mold of claim 9 in which We height of said channel is from about 0.15 to about 0.6 inches, and the depth of said channel is from about 0.1 to about 0.25 inches.

* * * * *